United States Patent [19]

Smith, III et al.

[11] 4,272,917

[45] Jun. 16, 1981

[54] STEERING ASSEMBLY RENDERING CAR UNSTABLE IN A TURN

[75] Inventors: Jay Smith, III, Pacific Palisades; Richard L. Malone, Manhattan Beach, both of Calif.

[73] Assignee: Smith Engineering, Santa Monica, Calif.

[21] Appl. No.: 115,229

[22] Filed: Jan. 25, 1980

[51] Int. Cl.[3] ..... A63H 30/04; A63H 17/36

[52] U.S. Cl. ..... 46/254; 46/262; 180/79.1; 280/95 R

[58] Field of Search ..... 46/201, 202, 206, 211, 46/221, 254, 255, 262; 180/79.1; 280/95 R

[56] References Cited

U.S. PATENT DOCUMENTS

| | | | |
|---|---|---|---|
| 2,224,408 | 12/1940 | Peglow | 280/772 |
| 3,246,719 | 4/1966 | Lahr | 180/79.1 |
| 3,820,809 | 6/1974 | Blonar | 280/112 A |
| 4,183,184 | 1/1980 | Barris et al. | 46/254 |

FOREIGN PATENT DOCUMENTS

| | | | |
|---|---|---|---|
| 372829 | 4/1923 | Fed. Rep. of Germany | 46/221 |
| 1269304 | 7/1961 | France | 46/201 |

*Primary Examiner*—F. Barry Shay

*Attorney, Agent, or Firm*—Jackson, Jones & Price

[57] ABSTRACT

A steering assembly particularly adapted for incorporation into a remote controlled toy car is disclosed. The steering assembly includes a pair of kingpins which fixedly mount two steered wheels of the toy car. The kingpins are pivotably mounted on axles attached to a chassis of the toy car. The kingpins are also moveable on their respective axles in a substantially vertical direction relative to the chassis of the toy car. A mechanism is provided to simultaneously pivot both kingpins about their respective axles in a proportional response to a steering input by a player so that the steered wheels of the cars are turned to a desired extent. Each kingpin is in an operative camming relationship with at least one member fixedly attached to the chassis of the toy car so that the kingpin located on the inside of a turn is caused to move downward and the other kingpin located on the outside of the turn is caused to move upward. The respective up and down motions of the kingpins which carry the wheels cause a decrease in a frictional engagement of the outside wheel with the support surface and thereby cause directional instability of the toy car in the turn.

21 Claims, 6 Drawing Figures

FIG. 1
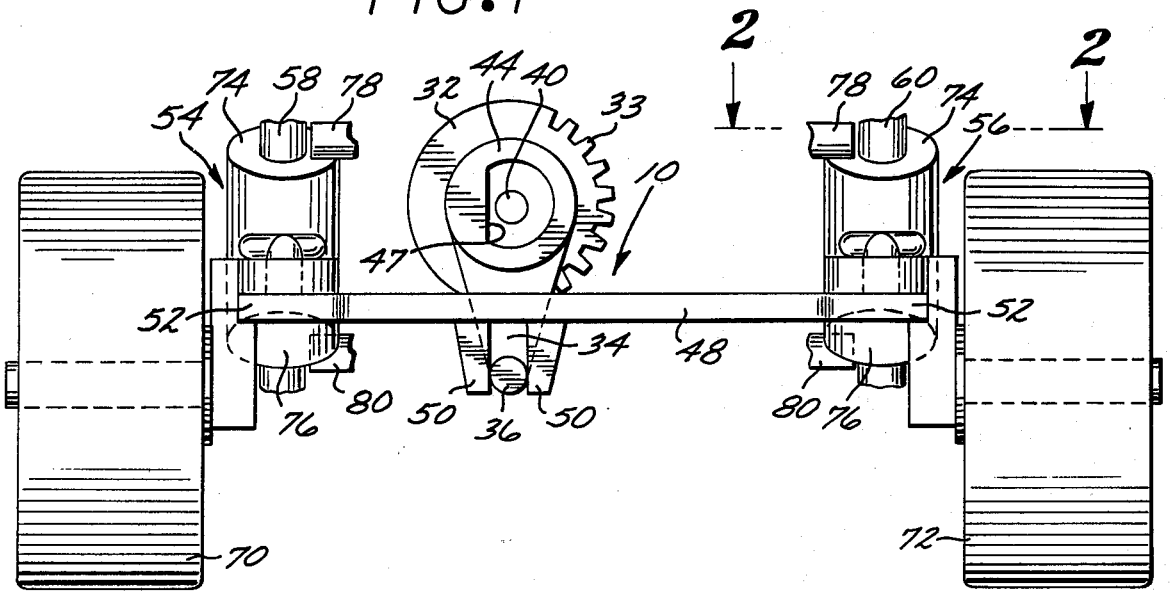
FIG. 2
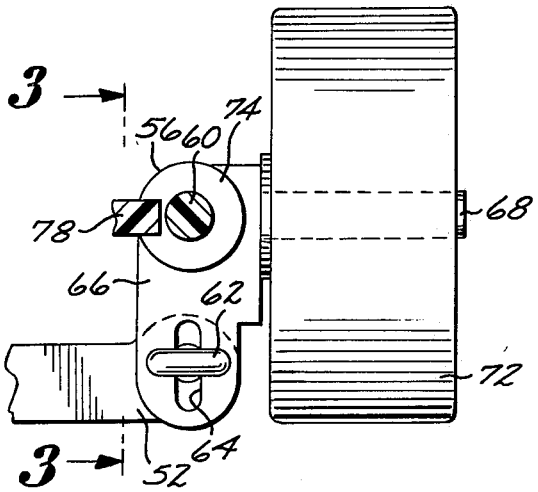
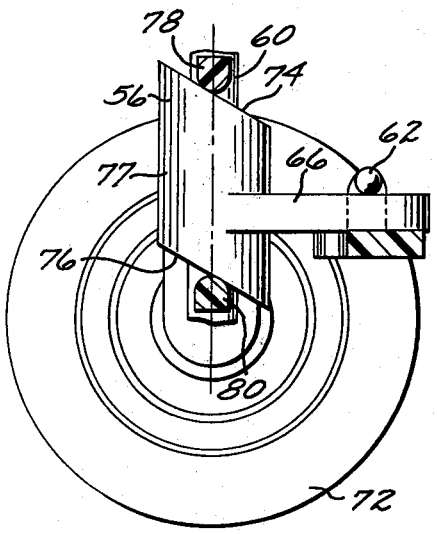
FIG. 3
FIG. 4
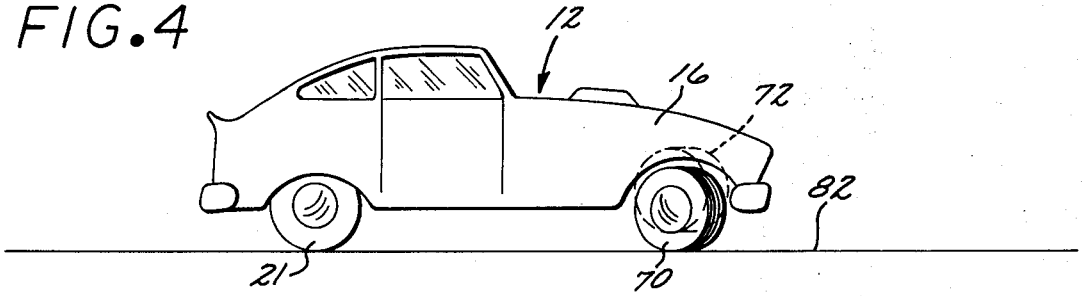

FIG. 5
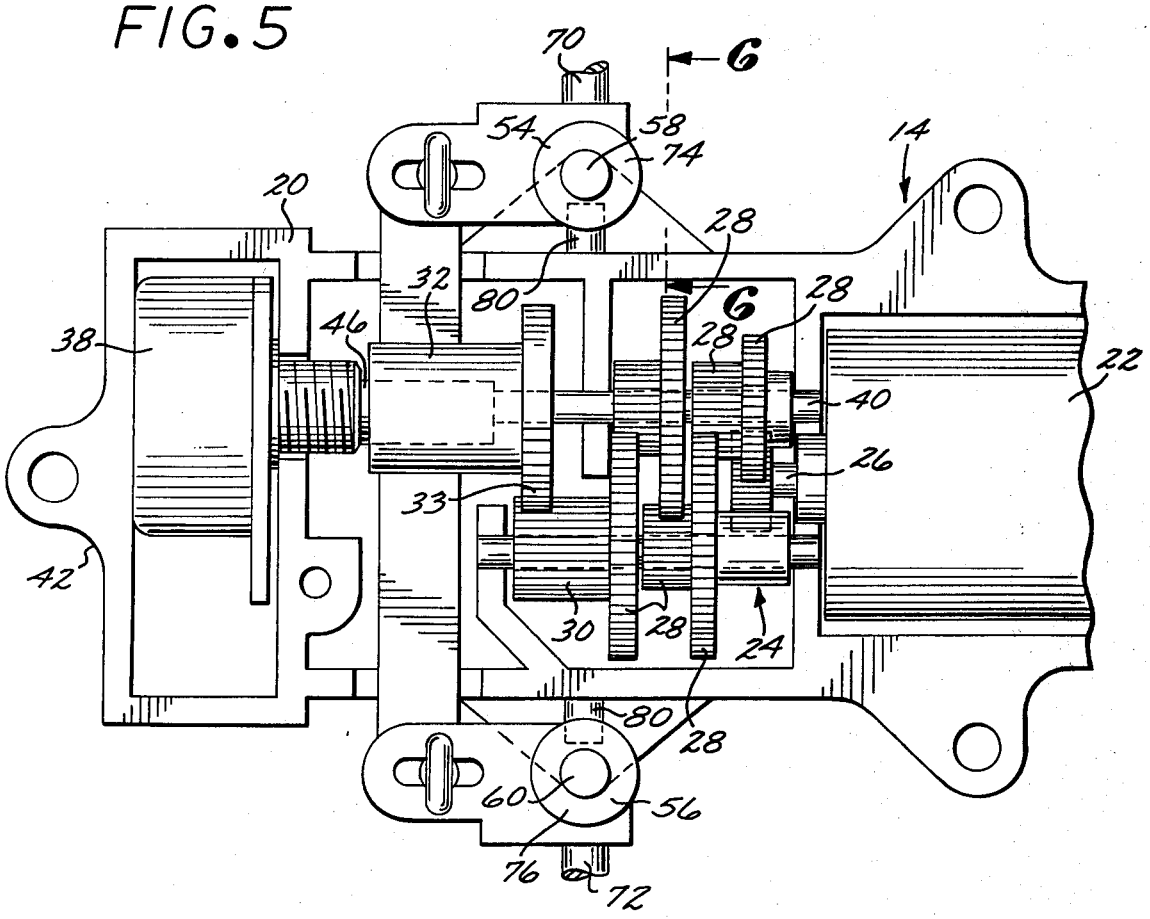
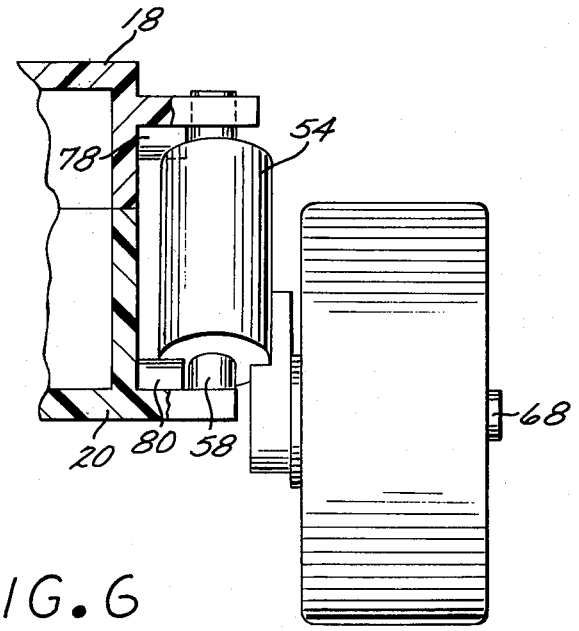
FIG. 6

STEERING ASSEMBLY RENDERING CAR UNSTABLE IN A TURN

BACKGROUND OF THE INVENTION

1. Field of the Invention

The present invention is directed to a toy car steering assembly, and more particularly to a steering assembly for a radio controlled toy car which is adapted for rendering the toy car directionally unstable in a turn.

2. Brief Description of the Prior Art

The prior art is well aware of radio controlled toy cars. Some radio controlled toy cars of the prior art have included a steering motor and a reducing gear train which is coupled to a potentiometer and to a conventional toy car steering mechanism.

The conventional steering mechanism typically includes a tie-bar and a pair of pivotable kingpins which are engaged by the tie-bar in eccentric relationship to the axes of pivot of the kingpins. Rotation of the steering motor is translated through the reducing gear train to lateral motion of the tie-bar. Two steered wheels of the car are affixed to the kingpins so that lateral motion of the tie-bar pivots the kingpins thereby turning the steered wheels of the car. The potentiometer senses when the steering motor has turned the steering wheel to the extent dictated by an input of a player, and through an appropriate electronic feedback mechanism causes deenergization of the steering motor. Thus, in effect the steering motor rotates and turns the steered wheels of the toy car in proportion to the steering input optionally selected by the player. The above summarized steering assembly is customarily termed in the art proportional steering assembly or proportional steering.

Generally speaking, the main objectives of the self-propelling toy car industry and particularly of the self-propelling radio controlled toy car industry have included making the toy cars faster, more responsive in obeying steering commands and more directionally stable in turns. In so doing, the prior art has largely ignored the play value of a toy car which is deliberately rendered directionally unstable in a turn. Such a toy car provides, in a child's imagination, a realistic imitation of a high speed racing car which "crashes" in a turn. The present invention is directed to such a toy car.

SUMMARY OF THE INVENTION

It is an object of the present invention to provide a steering assembly for a toy car which renders the toy car directionally unstable in a turn.

It is another object of the present invention to provide a steering assembly for a remotely controlled toy car which renders the car directionally unstable in a turn.

It is still another object of the present invention to provide a porportional steering assembly for a radio controlled toy car which renders the car unstable in a turn when a predetermined steering input is reached by a player.

These and other objects and advantages are attained by a steering assembly adapted to be incorporated into a self-propelling toy car. The steering assembly includes a first and a second kingpin which respectivey bear first and second steered wheels of the toy car. Each kingpin is rotatable about a substantially vertically disposed axis, and is also movable to a predetermined extent in a substantially vertical direction relative to a chassis of the toy car. A mechanism is provided to simultaneously pivot both kingpins about their respective axes in a proportional response to a steering input by a player so that the steered wheels of the car are turned to a desired extent. Each kingpin is in an operative camming relationship with at least one member fixedly attached to the chassis of the toy car so that the kingpin located on the inside of a turn is caused to move downward and the other kingpin located on the outside of the turn is caused to move upward. A direction of the turn is determined by the optional steering input of the player. The respective up and down motions of the kingpins which carry the wheels cause a decrease in a frictional engagement of the outside wheel with a support surface and thereby cause directional instability of the toy car in the turn.

The objects and features of the present invention are set forth in the appended claims. The present invention may be best understood by reference to the following description, taken in connection with the accompanying drawings in which like numerals indicate like parts.

BRIEF DESCRIPTION OF THE DRAWINGS

FIG. 1 is a schematic front plan view of a preferred embodiment of the steering assembly of the present invention;

FIG. 2 is a schematic partial, cross sectional view of the preferred embodiment of the steering assembly of the present invention, the cross section being taken on lines 2—2 of FIG. 1;

FIG. 3 is another, schematic partial, cross sectional view of the preferred embodiment of the steering assembly of the present invention, the cross section being taken on lines 3—3 of FIG. 2;

FIG. 4 is a schematic side view of a toy car incorporating the preferred embodiment of the steering assembly of the present invention, the view showing with dotted lines a wheel located on the outside of a turn and lifted off a support surface;

FIG. 5 is a top view of a steering assembly housing of a toy car incorporating the preferred embodiment of the steering assembly of the present invention, a top part of the steering assembly housing being omitted from the view for the sake of clarity, and FIG. 6 is a partial cross sectional view taken on lines 6—6 of FIG. 5.

DESCRIPTION OF THE PREFERRED EMBODIMENT

The following specification taken in conjunction with the drawings sets forth the preferred embodiment of the present invention in such a manner that any person skilled in the toy car manufacturing arts can use the invention. The embodiment of the invention disclosed herein is the best mode contemplated by the inventors for carrying out their invention in a commercial environment, although it should be understood that various modifications can be accomplished within the scope of the present invention.

Referring now to the drawing Figures and particularly to FIGS. 1 and 5, a preferred embodiment of the steering assembly 10 of the present invention incorporated into a radio controlled toy car 12, is disclosed. It should be noted at the outset that the steering assembly 10 of the present invention is particularly adapted for incorporation into a self-propelled radio controlled toy car. For this reason, the ensuing description is principally directed to the steering assembly used in a radio controlled toy car 10 such as the one shown on the drawing Figures. Nevertheless, it should be understood that the steering assembly 10 can also be incorporated in various self-propelled toy cars wherein a steering input is provided by a player.

Still referring principally to FIGS. 1 and 5, a steering assembly housing 14 of the toy car 12 is shown. The steering assembly housing 14 is connected to a general chassis 16 of the toy car 12 with a plurality of screws (not shown). For simplicity of illustration, the general chassis 16 is shown only on FIG. 4, and an upper part 18 of the steering assembly housing 14 is omitted from FIG. 5 but is shown in part on FIG. 6. The chassis 16 and the upper 18 and a lower steering assembly housing 20 of the toy car 12 may be conveniently manufactured by injection molding suitable plastic material, although other materials may also be used. A suitable drive motor (not shown) is mounted in the chassis 16 to provide locomotion to the toy car 12 through its rear wheels 21.

The steering assembly housing 14 includes an electrically powered steering motor 22 and a suitable reducing gear train 24 which reduces the rotation of a rotating output shaft 26 of the steering motor 22 in an approximately 30:1 to 100:1 ratio. The reducing gear train 24 includes a plurality of intermediate gears 28 and an output gear 30. The output gear 30 is meshed with a rotatable member 32 having gear teeth 33 on a portion of its periphery. The rotatable member 32 has a downwardly projecting part 34 which bears a projection or pin 36. The steering motor 22 and the reducing gear train 24 are best shown on FIG. 5, and the rotatable member 32, its downwardly projecting part 34 and the pin 36 are best shown on FIG. 1.

The rotatable member 32 is coupled to a potentiometer 38 shown on FIG. 5, and therefore is also called the potentiometer-coupler. The rotatable member or potentiometer-coupler 32 is free to rotate on a substantially horizontally disposed axle 40, which also bears a plurality of the intermediate gears 28. The potentiometer 38 is stationarily mounted within the steering assembly housing 14 adjacent to the front 42 of the housing 14 and therefore adjacent to a front of the toy car 12. A main body 44 of the potentiometer-coupler is hollow, and receives a rotating shaft 46 of the potentiometer 38 so that rotation of the potentiometer-coupler 32 turns the shaft 46. In order to register the shaft 46 inside the hollow main body 44 of the potentiometer-coupler 32 for synchronous rotation therewith, the main body 44 has a flat receiving surface 48 and the shaft 46 has a matching flat surface (not shown).

In accordance with the brief description in the introductory portion of the present application, rotation of the steering motor 22 in response to a steering input by a player results in adjustment in the resistance of the potentiometer 38. The adjusted resistance causes, through appropriate feedback means, deenergization of the steering motor 22 when a desired steering effect is attained. An electrical circuitry capable of attaining this result need not be described here because such circuitry is well known by persons skilled in the radio controlled toy car manufacturing arts. It is sufficient to know for the purpose of understanding the present invention, that the rotational displacement of the potentiometer-coupler 32 is proportional to a steering input effected by a player (not shown).

Referring now principally to FIG. 1, attachment of the substantially horizontally disposed projection or pin 36 of the potentiometer-coupler 32 to a tie-bar 48 is shown. The tie-bar 48 includes two downwardly projecting prongs 50 which entrap the pin 36. The pin 36 is entrapped loosely between the prongs 50 so that an arcuate motion of the pin 36 can be transformed into a lateral, linear motion of the tie bar 48.

Each end 52 of the tie-bar 48 is pivotably mounted to a kingpin, as is best shown on FIGS. 1 and 2. The kingpins are mounted substantially to lateral sides of the toy car 12 and respectively bear the reference numerals 54 and 56. Each kingpin 54 or 56 is pivotably mounted to a substantially vertically disposed axle which is stationary relative to the steering assembly housing 14 and relative to the toy car chassis 16. The substantially vertical axles of the kingpins 54 and 56 respectively bear the reference numerals 58 and 60. The kingpins 54 and 56 are also slideable to a predetermined extent on their respective axles 58 and 60 in a substantially vertical direction. The importance of the vertical movement of the kingpins 54 and 56 will be appreciated as the operation of the novel steering assembly 10 is further disclosed below.

Referring still principally to FIG. 2, the tie-bar 48 is shown to be attached to each kingpin 54 in an eccentric position relative to the respective axle 58 or 60 of the kingpin 54 or 56. Both kingpins 54 and 56 and the tie-bar 48 may be manufactured from a suitable plastic material. Accordingly, a pivotable mounting of the tie-bar 48 to each kingpin 54 and 56 may be accomplished by inserting a T shaped protrusion 62 of the tie-bar 48 into an elongated aperture 64 provided in a horizontally disposed section 66 of the kingpin. This simple and inexpensive mounting arrangement is best shown on FIGS. 2 and 3.

Each kingpin 54 and 56 carries a substantially horizontally disposed wheel axle 68 upon which a front, steered wheel of the toy car 12 is rotatably mounted. The front, steered wheels bear the reference numerals 70 and 72. The wheel axles 68 are disposed substantially below the tie-bar 48 so as to give good ground clearance to the toy car 12.

It is a principal feature of the present invention that a conventional steering action of the steering assembly 10 is coupled with a simultaneous lifting of one front, steered wheel and a lowering of the other front, steered wheel. In order to accomplish this, a first and a second camming surface 74 and 76 are provided in each kingpin 58 and 60.

In the herein described preferred embodiment of the steering assembly 10 of the present invention, each kingpin 58 and 60 is configured substantially as a cyindrical body 77 having its general longitudinal axis coinciding with the respective axle 58 or 60 of the kingpin 54 or 56. The camming surfaces 74 and 76 are configured as parallel truncation surfaces of the cylindrical body 77, the truncation being at an acute angle relative to the longitudinal axis of the cylindrical body 77. Thus, each camming surface 74 and 76 has a substantially elliptical periphery 78, as is best discernible on FIG. 1. FIGS. 1 and 3 also show that the first, top truncation or camming surface 74 of each kingpin 58 and 60 is inclined towards the front 42 of the toy car 12, and that the second, lower truncation or camming surface 76 is parallel with the first camming surface 74. In the herein described preferred embodiment the acute, truncation angle is approximately 30°.

Stationary or camming members are attached respectively to the upper 18 and to the lower parts 20 of the steering assembly housing 16 and are in operative camming relationship with each camming surface 74 and 76. The stationary or camming members which are attached to the upper part 18 of the steering assembly housing 16 are shown on FIGS. 1, 2, 3 and 6 and bear the reference numeral 78. Conversely, stationary or camming members attached to the lower part of the steering assembly housing 20 are shown on FIGS. 1, 3 and 5 and bear the reference numeral 80.

It should be readily apparent from the above description and from an inspection of the drawing Figures, that as the toy car 12 is steered into a turn the kingpins 54 and 56 pivot about their respective axles 58 and 60. At the same time, cooperation of the camming surfaces 74 and 76 with the stationary or camming members 78 and 80 move or slide one kingpin downwardly and the other kingpin upwardly on its respective axle of pivot. Consequently, one wheel 70 or 72 moves downward, towards a support surface 82 while the other wheel 70 or 72 moves upward and away from the support surface 82. The kingpin and the front wheel which moves downward is located on the inside of the turn while the kingpin and the wheel moving upward is located on the outside of the turn. The direction of the turn is, of course, determined by a player who gives an appropriate steering input command through the radio controlled steering motor 22.

It will be readily appreciated by those skilled in the art, that as the wheel located on the outside of the turn moves upward, its frictional engagement with the support surface 82 decreases. At the same time frictional engagement of the wheel located on the inside of the turn is unaffected or even increased. An overall effect is a decrease in the directional stability of the traveling toy car 12. In fact, when the speed of the toy car 12 and the angle of the turn reaches a critical value, the toy car pivots around the inside wheel and spins out of the turn. In the herein described preferred embodiment this usualy happens at a degree of turn which causes total separation of the outside wheel from the support surface 82.

FIG. 4 schematically shows with dotted lines the outside front wheel 72 being lifted off the support surface 82. In this mode the toy car 12 is incapable of properly negotiating a turn and spins out of it thereby providing amusement to a child player in realistic imitation of a racing car "crashing" in a turn.

It is emphasized that the hereinbefore described specific arrangement of the camming surfaces 74 and 76 and of the stationary camming members 78 and 80 is exemplary rather than limiting in nature. In other embodiments of the present invention the camming surfaces 74 and 76 may be inclined at various angles relative to the general longitudinal axis of the respective kingpin 54 and 56. It is apparent that the sharper is the acute angle of the inclination, the greater is the vertical displacement of the respective kingpin. By providing, for example, different angles of inclination of the camming surfaces on one side of the toy car 12 than on the other, it is possible to destabilize the toy car 12 to a different extent in a turn in one direction than in another direction. Additionally, instead of having two camming surfaces on each kingpin only one camming surface may be provided.

It is also possible to provide a camming relationship of only one kingpin with a stationary member so that the kingpin is lowered on the inside of a turn. In this case, the other kingpin on the outside of the turn would be automatically lifted off the support surface.

Several variations in the shape of the camming surfaces and of the cooperating stationary camming members are also possible within the scope of the present invention. The camming surfaces may be curved rather than flat surfaces. By appropriate shaping of the camming surfaces it is possible to lift the wheel on the outside of a turn only after a predetermined degree of turn is exceeded. In this case, the toy car may be rendered stable in a relatively gentle turn but unstable in a sharp turn.

As still another alternative, the inclined or curved camming surfaces may be incorporated in the stationary members. In such a case the kingpins are formed as cam followers moving up and down on the stationary camming surfaces dependent on the relative rotational positioning of the kingpins. Several other modifications may become readily apparent to those skilled in the art in light of the above teachings. Accordingly, the scope of the present invention should be interpreted solely from the following claims.

What is claimed is:

1. A steering assembly adapted for incorporation into a toy car and for rendering the toy car unstable in a turn thereby enhancing the play value of the toy car, the steering assembly comprising:

a first kingpin incorporated in a toy car chassis and fixedly connected to a first axle bearing a first wheel;

a second kingpin incorporated in the toy car chassis and fixedly connected to a second axle bearing a second wheel;

first means attached to the car chassis for pivoting the first kingpin and the second kingpin about a respective substantially vertically disposed axis at the option of a player, a pivoting motion of the first and second kingpins being coordinated so as to steer the toy car on a support surface, either one of the first and second kingpins being on the inside and the other kingpin being on the outside of a turn at the steering option of the player, and second means for lowering the kingpin and the connected wheel positioned on the inside of the turn towards the support surface, and for simultaneously raising the kingpin and the connected wheel positioned on the outside of the turn away from the support surface.

2. The invention of claim 1 wherein the second means comprise at least a first camming surface incorporated in the first kingpin, and at least a first member stationarily attached to the toy car chassis and being in a camming relationship with the first camming surface.

3. The invention of claim 2 wherein the camming surface is configured in such a manner that a respective wheel disposed on the outside of the turn lifts off the support surface at a predetermined angle of steering.

4. The invention of claim 1 wherein the second means comprise a first pair of camming surfaces incorporated in the first kingpin and a second pair of camming surfaces incorporated in the second kingpin, a first pair of members stationarily attached to the toy car chassis and being in camming relationship with the first pair of camming surfaces, and a second pair members stationarily attached to the toy car chassis and being in camming relationship with the second pair of camming surfaces.

5. The invention of claim 1 wherein the second means comprise at least one camming surface incorporated in each kingpin, each kingpin being substantially configured in the shape of a cylinder having a substantially vertically disposed longitudinal axis which coincides with the axis of pivot of the respective kingpin, the camming surface of each kingpin being a substantially flat surface having a substantially elliptical periphery and disposed on the respective kingpin at an acute angle to the longitudinal axis of the cylinder, and wherein the second means further comprise at least one member associated in a camming relationship with the camming surface of each kingpin, each member being stationarily attached to the toy car chassis.

6. The invention of claim 5 wherein each kingpin has two parallel disposed camming surfaces and wherein there is one separate member for association in a camming relationship with each camming surface of each kingpin.

7. The invention of claim 6 wherein the first means comprise a tie-bar and a rotatable member operatively coupled to the tie-bar to move the tie-bar in a lateral direction in response to a steering input by the player, the tie-bar being operatively connected to the first and to the second kingpins.

8. The invention of claim 7 wherein the first means further comprise a radio controlled steering motor which drives the rotatable member.

9. A self-propelling toy car comprising:

a chassis;

a remote controlled steering motor incorporated in the chassis;

a rotatable member driven by said steering motor in response to and in proportion to a steering input provided by a player;

a first and a second kingpin, one kingpin being mounted substantially on each side of the chassis of the toy car, each kingpin being pivotable about a substantially vertically disposed axis and also being movable to a predetermined extent in a vertical direction relative to the chassis;

a first and a second wheel, the first wheel being connected to the first kingpin and the second wheel being connected to the second kingpin, the first and second wheels comprising the steered wheels of the toy car;

first means actuated by the rotatable member for pivoting the first kingpin and the second kingpin about their respective substantially vertically disposed axes so as to steer the toy car, and second means operatively associated with the first and second kingpins for lowering in a substantially vertical direction that kingpin which is on the inside of a turn, and for simultaneously raising in a substantially vertical direction that kingpin which is on the outside of the turn, the direction of the turn being determined by the player, whereby the respective wheel connected to the kingpin on the inside of the turn is lowered and the respective wheel connected to the kingpin on the outside of the turn is raised causing the toy car to become directionally unstable in the turn.

10. The invention of claim 9 wherein the second means is adapted for lifting off of a supporting surface the wheel on the outside of a turn when a predetermined steering angle is reached.

11. The invention of claim 9 wherein the second means comprise a first camming surface incorporated in the first kingpin, a second camming surface incorporated in the second kingpin, a first member fixedly attached to the chassis and being in operative camming relationship with the first camming surface, and a second member fixedly attached to the chassis and being in operative camming relationship with the second camming surface.

12. The invention of claim 11 wherein each kingpin is configured substantially in the shape of a truncated cylinder having the respective axis of pivot as its longitudinal axis and having a truncation surface which is disposed at an acute angle to the longitudinal axis, the truncation surfaces comprising the camming surfaces.

13. The invention of claim 12 wherein each kingpin has two parallel truncation surfaces of the kind set forth in claim 12, and wherein the second means further comprise a first pair of members fixedly attached to the chassis in a spaced relationship with one another, each member of the first pair of members being in a camming relationship relative to one truncation surface of the first kingpin, and wherein the second means still further comprise a second pair of members fixedly attached to the chassis in a spaced relationship with one another, each member of the second pair of members being in a camming relationship relative to one truncation surface of the second kingpin.

14. The invention of claim 13 wherein the first means include a tie-bar operatively connected to the rotatable member and capable of a sliding motion relative to the chassis, the tie-bar also being connected to the first and second kingpins.

15. The invention of claim 14 further comprising a reducing gear train receiving rotatory output of the steering motor and translating it to the rotatable member, the rotatable member being coupled to and turning a potentiometer which is operatively associated with the radio controlled steering motor.

16. In a self-propelling radio controlled toy car having a chassis, a radio controlled steering motor mounted to the chassis, a reducing gear train connected to the motor, and a steering assembly including a first and a second steered wheel, the steering assembly being driven by the motor through the gear train, the improvement comprising:

means operatively associated with and included in the steering assembly for lowering either one of the steered wheels with respect to the other steered wheel when the toy car is steered in a turn, the direction of which is determined by a player, the lowered wheel being in the inside of the turn whereby the car becomes directionally unstable in the turn.

17. The improvement of claim 16 wherein the means comprise a pair of kingpins included in the steering assembly, each kingpin being pivotable relative to the chassis on a substantially vertically disposed axle, at least one kingpin also being slideable to a predetermined extent in a substantially vertical direction relative to the respective vertically disposed axle, the slideable kingpin mounting one of the steered wheels of the toy car and having at least one camming surface, the means further comprising at least one member stationarily attached to the chassis adjacent to the slideable kingpin and being in operative camming relationship with the camming surface of the slideable kingpin to move the slideable kingpin in a vertical direction when the car is turned at the option of the player.

18. The improvement of claim 17 wherein each kingpin includes a first camming surface substantially at its lower end and a second camming surface substantially at its upper end, the first and second camming surfaces being substantially parallel disposed with one another, and wherein a first member and a second member are stationarily attached to the chassis respectively adjacent to each kingpin, the first member being in operative camming relationship with the first camming surface, and the second member being in operative camming relationship with the second camming surface.

19. The improvement of claim 18 wherein each kingpin is configured substantially as a cylinder having a pair of parallel disposed truncation surfaces, the truncation surfaces comprising the respective first and second camming surfaces.

20. The improvement of claim 19 wherein the truncation surfaces respectively comprise substantially flat surfaces inclined at an acute angle relative to the vertical direction.

21. The improvement of claim 20 wherein the acute angle is approximately 30°.

* * * * *

UNITED STATES PATENT AND TRADEMARK OFFICE

CERTIFICATE OF CORRECTION

PATENT NO. : 4,272,917

DATED : June 16, 1981

INVENTOR(S) : Jay Smith, III et al

It is certified that error appears in the above—identified patent and that said Letters Patent is hereby corrected as shown below:

Column 6, line 63, after "pair" insert -- of --.

Signed and Sealed this

*Tenth* Day of *November 1981*

[SEAL]

*Attest:*

GERALD J. MOSSINGHOFF

*Attesting Officer*

*Commissioner of Patents and Trademarks*